US011763778B2

(12) United States Patent
Glen

(10) Patent No.: US 11,763,778 B2
(45) **Date of Patent: *Sep. 19, 2023**

(54) REDUCED VERTICAL BLANKING REGIONS FOR DISPLAY SYSTEMS THAT SUPPORT VARIABLE REFRESH RATES

(71) Applicant: ATI TECHNOLOGIES ULC, Markham (CA)

(72) Inventor: David I. J. Glen, Markham (CA)

(73) Assignee: ATI TECHNOLOGIES ULC, Markham (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/884,793

(22) Filed: Aug. 10, 2022

(65) Prior Publication Data

US 2023/0053263 A1 Feb. 16, 2023

Related U.S. Application Data

(63) Continuation of application No. 17/030,676, filed on Sep. 24, 2020, now Pat. No. 11,417,295.

(51) Int. Cl.
*G09G 5/36* (2006.01)
*G09G 3/20* (2006.01)

(52) U.S. Cl.
CPC ..... *G09G 5/363* (2013.01); *G09G 3/20* (2013.01); *G09G 2310/061* (2013.01); *G09G 2310/08* (2013.01)

(58) Field of Classification Search
CPC .... G09G 5/363; G09G 3/20; G09G 2310/061; G09G 2310/08
See application file for complete search history.

(56) References Cited

U.S. PATENT DOCUMENTS

| | | | | |
|---|---|---|---|---|
| 2008/0055318 | A1 | 3/2008 | Glen | |
| 2008/0100598 | A1 | 5/2008 | Juenger | |
| 2015/0346528 | A1 | 12/2015 | Ge et al. | |
| 2016/0092010 | A1 | 3/2016 | Agarwal et al. | |
| 2016/0275916 | A1* | 9/2016 | Glen | G09G 5/395 |
| 2017/0124934 | A1* | 5/2017 | Verbeure | G09G 3/3611 |

OTHER PUBLICATIONS

Notice of Allowance issued in U.S. Appl. No. 17/030,659, dated Oct. 28, 2022, 10 pages.
International Preliminary Report on Patentability issued in Application No. PCT/IB2021/058658, dated Apr. 6, 2023, 8 pages.
International Preliminary Report on Patentability issued in Application No. PCT/IB2021/058694, dated Apr. 6, 2023, 7 pages.

* cited by examiner

*Primary Examiner* — Robert J Michaud

(57) ABSTRACT

A graphics processing unit (GPU) includes a timing reference one or more processors configured to generate and provide, based on the timing reference, frames to a display system that supports variable refresh rates. The frames include a vertical blanking region having a first duration. The display system transmits information indicating an operation to be performed by the display system during the vertical blanking region of one or more subsequent frames. The one or more processors are configured to increase the first duration to a second duration in response to receiving the information indicating an operation to be performed by the display system during the vertical blanking region of at least one subsequent frame. In some cases, the first duration of the vertical blanking region is a minimum duration that corresponds to a maximum refresh rate supported by the display system.

20 Claims, 4 Drawing Sheets

REDUCED VERTICAL BLANKING REGIONS FOR DISPLAY SYSTEMS THAT SUPPORT VARIABLE REFRESH RATES

CROSS-REFERENCE TO RELATED APPLICATIONS

The present application is a Continuation application of U.S. patent application Ser. No. 17/030,676, entitled "REDUCED VERTICAL BLANKING REGIONS FOR DISPLAY SYSTEMS THAT SUPPORT VARIABLE REFRESH RATES", and filed on Sep. 24, 2020, the entirety of which is incorporated by reference herein.

BACKGROUND

A display system includes a screen that displays video rendered by a processor such as a graphics processing unit (GPU) and provided to the display system in a stream of frames. The display video timing is determined by a frame rate (or refresh rate), a number of pixels per line in the frame (HTotal), a number of lines per frame (VTotal), and a pixel clock rate (PClk) that is equal to the product of the refresh rate, the number of pixels per line, and the number of lines per frame. The number of pixels per line includes a horizontal active region that includes pixel values used to generate images and a horizontal blanking region that conveys other information such as digital audio or metadata. Thus, the total number of pixels per line is equal to a sum of the pixels in the horizontal active region and the pixels in the horizontal blanking region. The number of lines per frame includes a vertical active region that includes pixel values and a vertical blanking region that conveys other information such as digital audio or metadata. Thus, the total number of lines per frame is equal to a sum of the lines in the vertical active region and the lines in the vertical blanking region. For example, a high definition frame can represent an image using 1080 active vertical lines that include values of the pixels and 45 vertical blanking lines. A line rate for the frame is defined as the pixel clock rate divided by the number of pixels per line or, equivalently, as the product of the refresh rate and the number of lines per frame.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
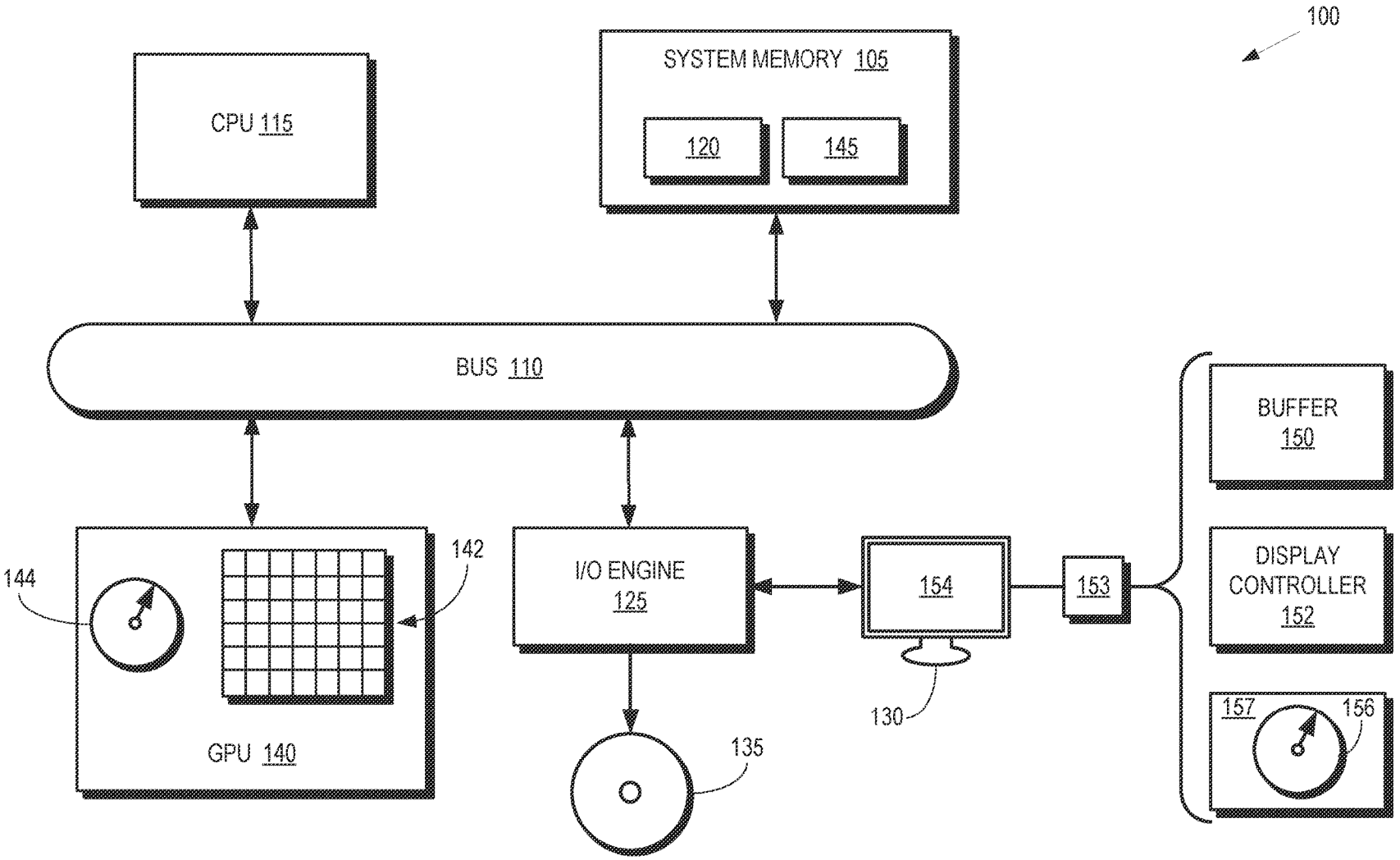
FIG. 1 is a block diagram of a processing system that selectively reduces a vertical blanking region for frames provided to a display system that supports variable refresh rates according to some embodiments.

A minimum duration of a vertical blanking region in a frame is determined by standards that are implemented in a processor (such as a GPU) and a display system. For example, the Harmonized Video Timing (HVT) standard sets a minimum duration of the vertical blanking time at about 300 microseconds (μs) and the Coordinated Video Timing (CVT) standard sets the minimum duration of the vertical blanking time at 460 μs. The frame refresh rates used by applications such as video games have increased from frequencies on the order of 120 Hz to frequencies of 240 Hz, 480 Hz, and perhaps higher as the graphics requirements of the applications continue to increase. Consequently, the percentage of each frame that is reserved for the vertical blanking region increases as the duration of the frame decreases, which requires an increase in the line rate and the pixel rate because the size of the active regions, e.g., the number of pixels per frame, remains the same. For example, at 480 Hz, the duration of the frame is 2.08 microseconds and the percentage of the frame consumed by the vertical blanking region is 14.4% for the 300 μs vertical blanking region in HVT and 22.1% for the 460 μs vertical blanking region in CVT. In order to reduce the percentage of the frame consumed by the vertical blanking region and improve the line and pixel rates, some displays implement a shorter, non-standardized vertical blanking region, e.g., 100 or 150 μs.

The processor performs different tasks during the active and blanking regions. While processing the horizontal and vertical active regions, the processor accesses the data used to display images from a memory via one or more memory interfaces and data fabric interfaces. In contrast, during some or all the vertical blanking regions there can be periods when no data is transferred over the memory/fabric interfaces. The processor can utilize these gaps in display processing during vertical blanking regions to perform other operations such as modifying a clock speed, retraining clocks used by the interfaces, modifying a power state of the processor, and other operations that require a gap in memory access/fabric delivery and that may cause interruptions in memory reads and fabric traffic. For example, the clock used by a memory interface can be retrained in response to a transition from a high frequency/high power state to a low frequency/low power state during the minimum vertical blanking times defined by HVT and CVT. However, the operations that the processor typically performs during the vertical blanking regions are difficult (or impossible) to complete within the reduced duration vertical blanking region. For example, a clock that drives a memory interface cannot be retrained in 100 μs.

FIGS. 1-4 disclose techniques for reducing a fraction of a frame that is consumed by a vertical blanking region for most frames, while also preserving the processor's ability to perform other operations such as changing power states and adjusting clock frequencies, by constraining the use of shorter vertical blanking regions to display systems that implement variable refresh rates. Some embodiments of the display system implement variable refresh rates to dynamically adapt the display refresh rate to variable frame rates received from a source, e.g., the frames associated with an irregular load produced when a processor is rendering complex gaming content. The refresh rate is varied by modifying vertical blanking regions of the frames while maintaining the size of the active regions and the pixel clock rate. In operation, the processor is initially providing frames having a reduced duration vertical blanking region such as 100 us or 150 μs. The processor increases the duration of the vertical blanking region, e.g., in response to the signaling indicating that an operation such as a changing power state or clock frequency adjustment should be (or will be) performed in one or more subsequent frames. In some embodiments, the processor defers transmitting a request to display a frame until the triggering operation is complete, thereby increasing the duration of the vertical blanking region of the frame. Modifying the frame rate to provide time to complete the operation does not cause visual artifacts such as stuttering because the display system is required to implement variable refresh rates to compensate for the processor's changing frame rate. Subsequent frames return to the minimum vertical blanking region if no further time needed.

FIG. 1 is a block diagram of a processing system 100 that selectively reduces a vertical blanking region for frames provided to a display system that supports variable refresh rates according to some embodiments. The processing system 100 includes or has access to a system memory 105 or other storage component that is implemented using a non-transitory computer readable medium such as a dynamic random-access memory (DRAM). However, some embodiments of the memory 105 are implemented using other types of memory including static RAM (SRAM), nonvolatile RAM, and the like. The processing system 100 also includes a bus 110 to support communication between entities implemented in the processing system 100, such as the memory 105. Some embodiments of the processing system 100 include other buses, bridges, switches, routers, and the like, which are not shown in FIG. 1 in the interest of clarity.

The processing system 100 includes at least one central processing unit (CPU) 115. Some embodiments of the CPU 115 include multiple processing elements (not shown in FIG. 1 in the interest of clarity) that execute instructions concurrently or in parallel. The processing elements are referred to as processor cores, compute units, or using other terms. The CPU 115 is connected to the bus 110 and communicates with the memory 105 via the bus 110. The CPU 115 executes instructions such as program code 120 stored in the memory 105 and the CPU 115 stores information in the memory 105 such as the results of the executed instructions. The CPU 115 is also able to initiate graphics processing by issuing draw calls.

An input/output (I/O) engine 125 handles input or output operations associated with a display system 130, as well as other elements of the processing system 100 such as keyboards, mice, printers, external disks, and the like. The I/O engine 125 is coupled to the bus 110 so that the I/O engine 125 communicates with the memory 105, the CPU 115, or other entities that are connected to the bus 110. In the illustrated embodiment, the I/O engine 125 reads information stored on an external storage component 135, which is implemented using a non-transitory computer readable medium such as a compact disk (CD), a digital video disc (DVD), and the like. The I/O engine 125 also writes information to the external storage component 135, such as the results of processing by the CPU 115.

The display system 130 supports a variable refresh rate so that the display system 130 can present frames at refresh rates within a range up to a maximum refresh rate. For example, the display system 130 can support refresh rates of 24 Hz, 25 Hz, 30 Hz, 50 Hz, 60 Hz, 100 Hz, and 120 Hz. The variable refresh rate corresponds to a variable vertical blanking region, which is within a range beginning at a minimum vertical blanking region that corresponds to the maximum refresh rate of the display system 130. In some embodiments, the refresh rates are determined by querying the display system 130 for its Enhanced Extended Display Identification Data (E-EDID) and determining the refresh rates from the E-EDID reply.

The processing system 100 includes at least one GPU 140 that renders images for presentation by the display system 130. For example, the GPU 140 renders objects to produce values of pixels that are provided to the display system 130, which uses the pixel values to display an image that represents the rendered objects. The GPU 140 includes one or more processing elements such as an array 142 of compute units that execute instructions concurrently or in parallel. Some embodiments of the GPU 140 are used for general purpose computing. In the illustrated embodiment, the GPU 140 communicates with the memory 105 (and other entities that are connected to the bus 110) over the bus 110. However, some embodiments of the GPU 140 communicate with the memory 105 over a direct connection or via other buses, bridges, switches, routers, and the like. The GPU 140 executes instructions stored in the memory 105 and the GPU 140 stores information in the memory 105 such as the results of the executed instructions. For example, the memory 105 stores a copy 145 of instructions that represent a program code that is to be executed by the GPU 140. The GPU 140 also includes a timing reference 144.

The GPU 140 generates a stream of frames that is provided to the display system 130. The GPU 140 renders frames at different refresh rates to match the variable refresh rates supported by the display system 130. For example, the GPU 140 renders frames and provides them to the display system 130 at 50 Hz in response to determining that the display system 130 is presenting frames at 50 Hz. For another example, the GPU 140 renders frames and provides them to the display system at 60 Hz in response to determining that the display system 130 is presenting frames at 60 Hz. Some embodiments of the display system 130 include a buffer 150 that stores the frames in the stream received from the GPU 140. The display system 130 also includes a display controller 152 that reads out the pixel values in the frames from the buffer 150 and uses the values to display an image on (or present an image to) a screen 154. The display controller 152 provides the frames via a display interface 153 (such as an HDMI or DisplayPort interface) configured to couple to the screen 154. The display system 130 also includes a timing reference 156, which is synchronized to the GPU timing reference 144 during normal operation. Some embodiments of the timing reference 156 are implemented in a timing controller (TCON) chip 157, e.g., as an application-specific integrated circuit (ASIC) or other circuit, which also performs timing and synchronization operations for the display system 130, as discussed herein.

The frames generated by the GPU 140 and displayed by the display system 130 are characterized by a number of pixels per line in the frame (HTotal), a number of lines per frame (VTotal), and a pixel clock rate (PClk) that is equal to the product of the refresh rate, the number of pixels per line, and the number of lines per frame. In some embodiments, the GPU 140 provides frames to the display system 130 at a relatively high refresh rate (corresponding to a reduced duration of a vertical blanking region) if the display system 130 supports a variable refresh rate. In some embodiments, the initial duration of the vertical blanking region is a minimum duration that corresponds to a maximum refresh rate supported by the display system. The reduced duration of the vertical blanking region is likely to be insufficient to perform some necessary operations at the display system 130. Consequently, if the display system 130 is going to perform one or more of these operations, the display system 130 transmits information indicating that the display system 130 is going to perform the operation(s) during the vertical blanking region of one or more subsequent frames. In response to receiving the information, the GPU 140 modifies a refresh rate for the frames by increasing the duration of the vertical blanking region in subsequent frames. The GPU 140 can also increase the refresh rate for the frames by decreasing the duration of the vertical blanking region in response to receiving an indication that the display system 130 has completed performing the operation and no longer requires the increase duration of the vertical blanking region.

Figure 2:
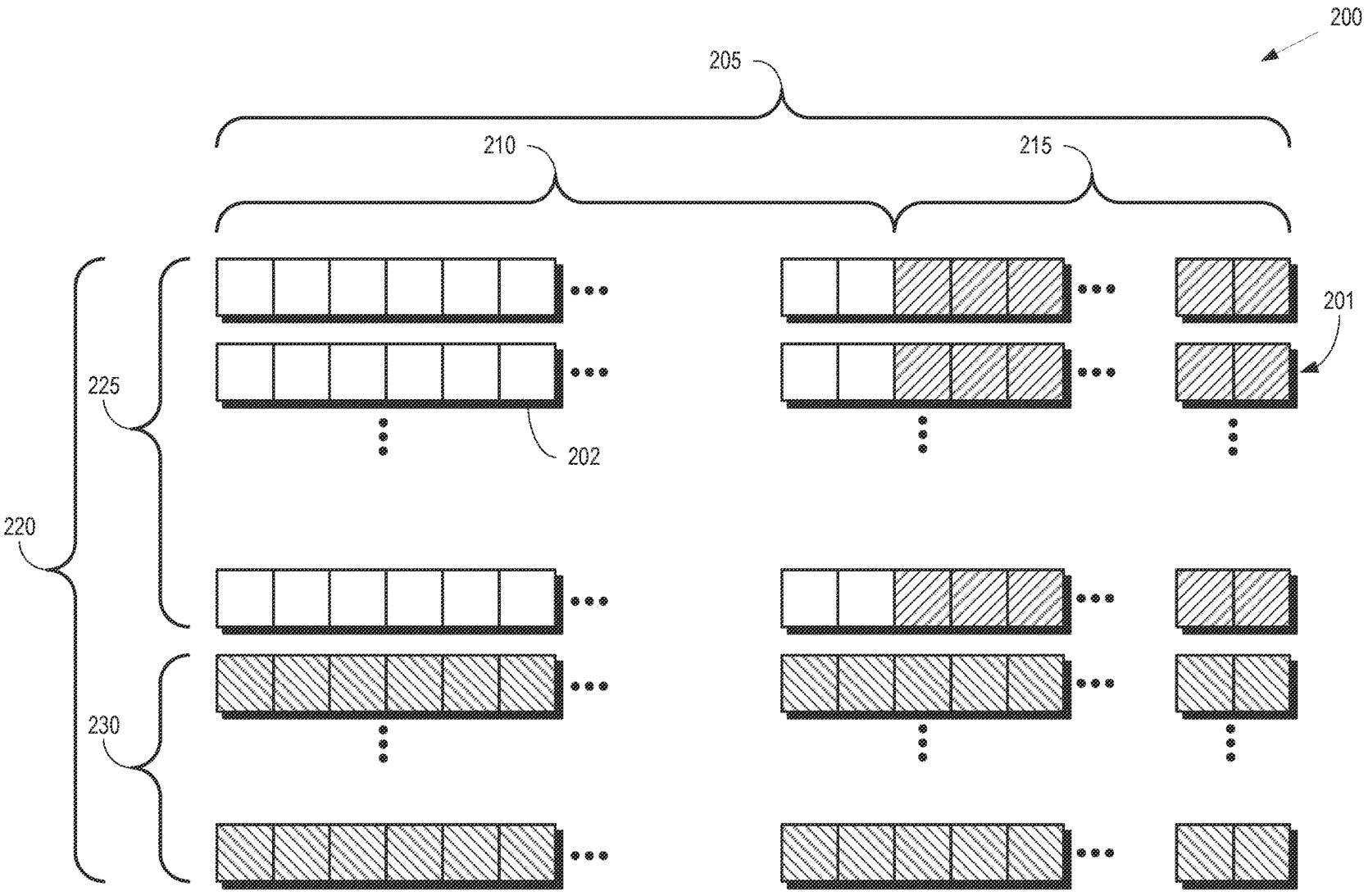
FIG. 2 is a block diagram of a frame that is generated by a GPU and provided to a display system according to some embodiments.

FIG. 2 is a block diagram of a frame 200 that is generated by a GPU and provided to a display system according to some embodiments. The frame 200 is generated (e.g., rendered) by some embodiments of the GPU 140 shown in FIG. 1 and displayed or presented by some embodiments of the display system 130 shown in FIG. 1.

The frame 200 is partitioned into lines 201 (only one indicated by a reference numeral in the interest of clarity) of pixels 202 (only one indicated by a reference numeral in the interest of clarity). Each line 201 includes a number 205 of pixels per line (HTotal). The number 205 of pixels per line includes a horizontal active region 210 that includes pixel values used to generate images (as indicated by the open boxes) and a horizontal blanking region 215 that conveys other information such as digital audio or metadata (as indicated by the hatched boxes). The frame 200 also includes a number 220 of lines per frame (VTotal). The number 220 of lines per frame includes a vertical active region 225 that includes pixel values (as indicated by the open boxes) and a vertical blanking region 230 that conveys other information such as digital audio or metadata (as indicated by the hatched boxes). Thus, the total number 220 of lines per frame is equal to a sum of the lines in the vertical active region 225 and the lines in the vertical blanking region 230. For example, a high definition frame can represent an image using 1080 active vertical lines that include values of the pixels and 45 vertical blanking lines.

The GPU provides the frame 200 (and the display system presents the frame 200) at a refresh rate. The frame 200 is therefore characterized by a pixel clock rate (PClk) that is equal to the product of the refresh rate, the number 205 of pixels per line, and the number 220 of lines per frame. A line rate for the frame 200 is defined as the pixel clock rate divided by the number 205 of pixels per line or, equivalently, as the product of the refresh rate and the number 220 of lines per frame. As discussed herein, the GPU modifies a duration of the vertical blanking region 230 based on requirements at the display system that is presenting the frame 200. The GPU initially generates frames having a reduced duration of the vertical blanking region 230 (corresponding to a higher refresh rate) such as a minimum duration of the vertical blanking region 230 determined by one or more standards implemented in the GPU and the display system. The GPU can increase the duration of the vertical blanking region 230 in response to an indication that the display system requires a longer duration, e.g., to perform one or more operations during the vertical blanking region 230.

Figure 3:
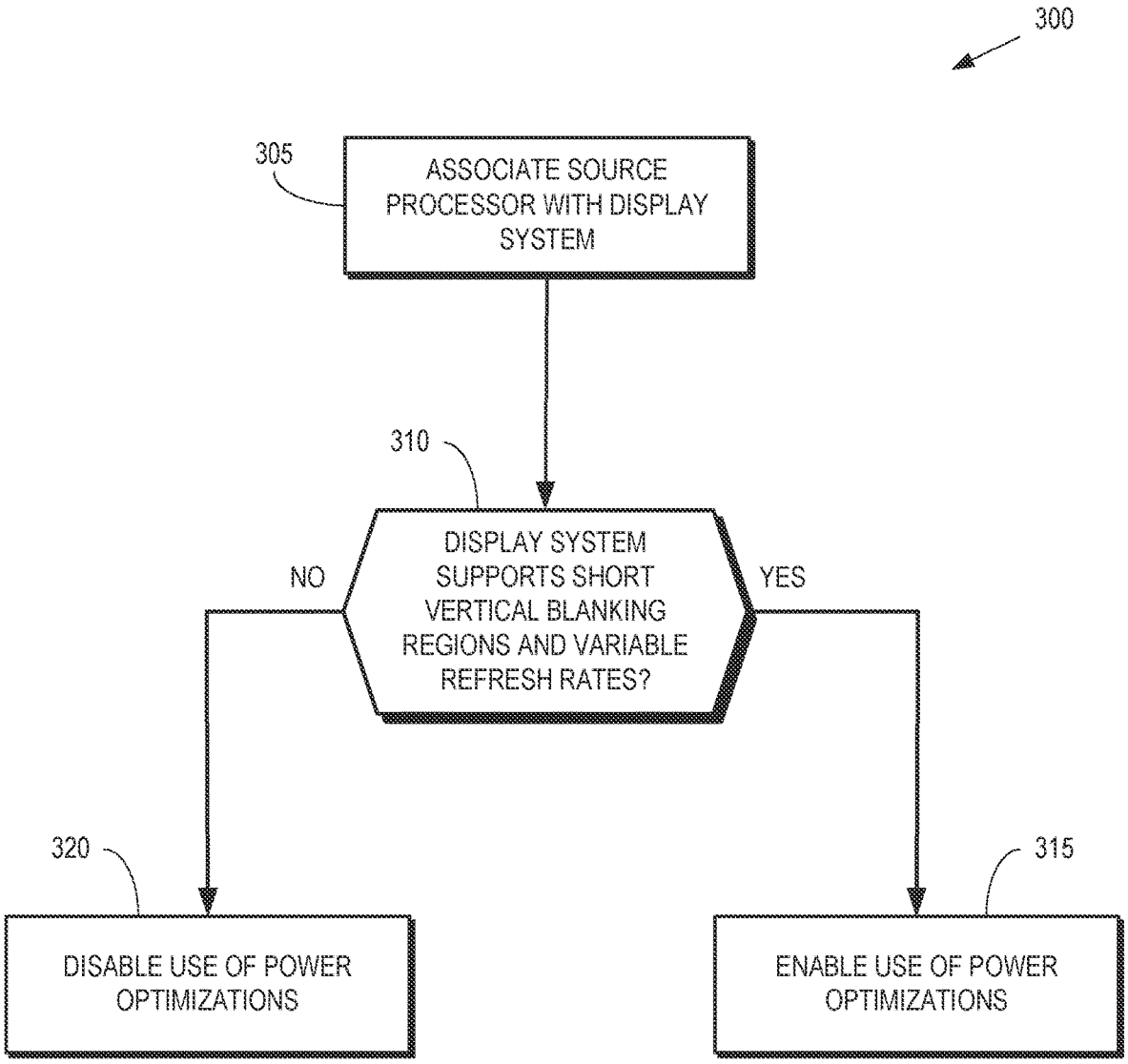
FIG. 3 is a flow diagram of a method of selectively enabling reduced or variable vertical blanking regions according to some embodiments.

FIG. 3 is a flow diagram of a method 300 of selectively enabling reduced or variable vertical blanking regions according to some embodiments. The method 300 is implemented in some embodiments of the processing system 100 shown in FIG. 1.

At block 305, a source processor (such as a GPU) is associated with a display system. As used herein, the term "associate" refers to providing information to the source processor that configures the source processor (or causes the source processor to be configured) to render and provide frames to the display system using parameters that are determined based on one or more characteristics of the display system. In some embodiments, the source processor and the display system are associated by forming a physical (e.g., wired or wireless) connection between the source processor and the display processor. The physical connection is then used to convey information between the devices, e.g., the source processor can query the display system for its E-EDID and generate configuration parameters based on information in the E-EDID reply received from the display system. In some embodiments, the source processor is configured based on characteristics of the display system that are provided to the source processor without necessarily connecting the source processor and the display system. For example, the characteristics of the display system can be provided to the source processor, and the source processor can be configured based on the characteristics, prior to connecting the source processor and the display system.

At decision block 310, the source processor determines whether the display system supports short (or variable) vertical blanking regions and variable refresh rates. In some embodiments, the determination is made based upon information received in an E-EDID reply from the display system. If the display system supports short (or variable) vertical blanking regions and variable refresh rates, the method 300 flows to the block 315. If the display system does not support short (or variable) vertical blanking regions and variable refresh rates, the method flows to the block 320.

At block 315, the display system supports short vertical blanking regions and variable refresh rates, which allows the display system to transition to longer vertical blanking regions that are used to configure the display system to support features including power optimizations. Use of the power optimizations is therefore enabled at block 315. In some embodiments, the source processor is configured to render and provide frames at a relatively high refresh rate using vertical blanking regions of a relatively short duration in most instances. However, in response to receiving signaling from the display system indicating a request for a longer duration of the vertical blanking region that is utilized by an additional feature such as power optimization, the source processor is configured to modify the duration of the vertical blanking region, e.g., by increasing the duration.

At block 320, the display system does not support short vertical blanking regions and variable refresh rates. In that case, the display system is not able to transition to longer vertical blanking regions that are used to configure the display system to support features including power optimizations. The use of additional features such as power optimization are therefore disabled at block 320. Instead, the source processor uses a fixed duration of the vertical blanking region that corresponds to the refresh rate supported by the display system.

Figure 4:
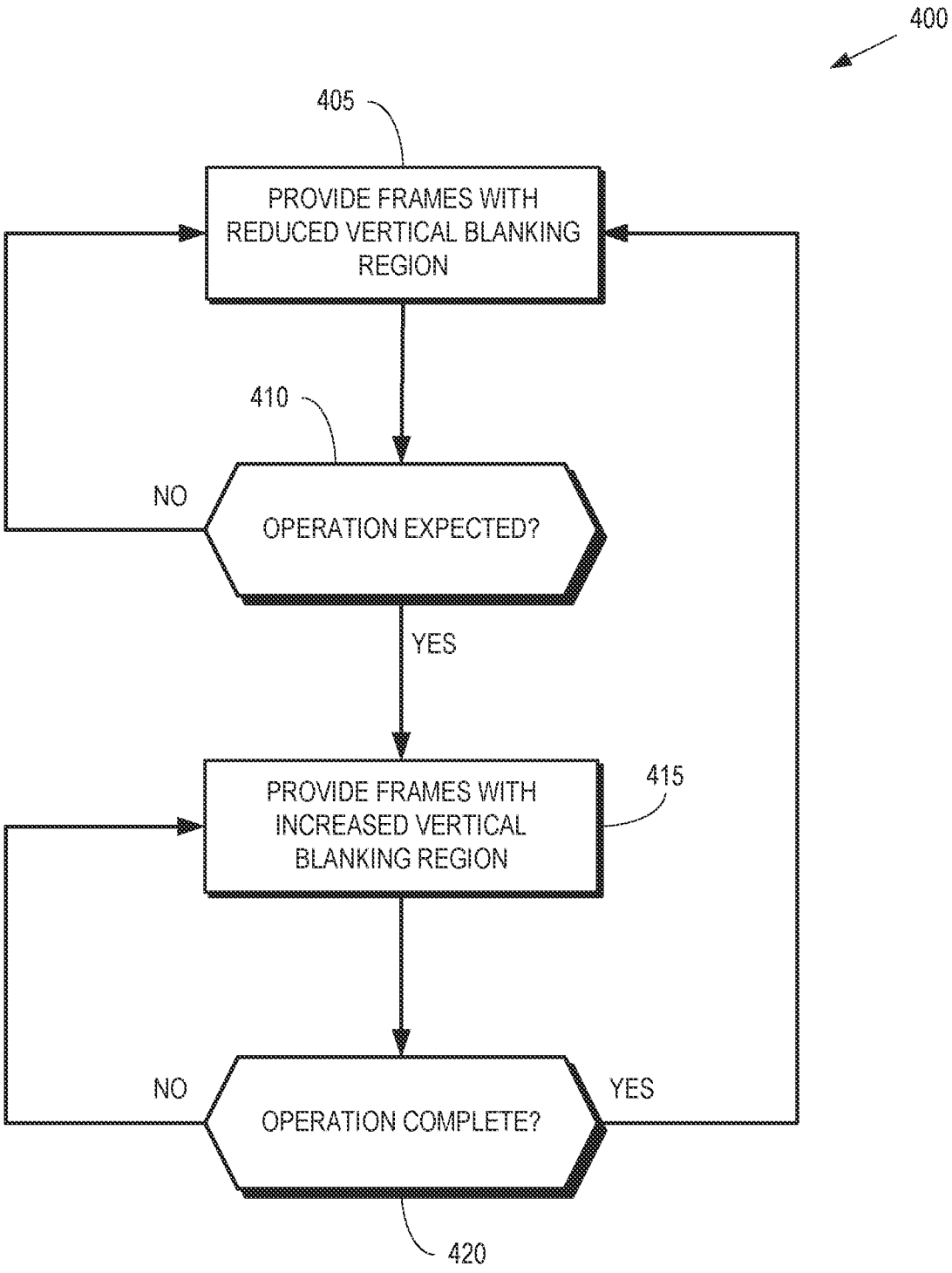
FIG. 4 is a flow diagram of a method of modifying durations of vertical blanking regions in frames generated by a source processor and provided to a display system according to some embodiments.

FIG. 4 is a flow diagram of a method 400 of modifying durations of vertical blanking regions in frames generated by a source processor and provided to a display system according to some embodiments. The method 400 is implemented in some embodiments of the processing system 100 shown in FIG. 1.

At block 405, the source processor is rendering frames with a reduced vertical blanking region and providing the rendered frames to the display system for display on a screen.

At decision block 410, the source processor determines whether the display system will require a longer vertical blanking region. Some embodiments of the display system provide an indication or a request for the longer vertical blanking region, e.g., to provide additional time to perform one or more operations at the display system. If a longer vertical blanking region has been requested, the method 400 flows to the block 415. Otherwise, the method 400 returns to block 405.

At block 415, the source processor increases the vertical blanking region and begins rendering frames with the increased vertical blanking region. The frames are provided to the display system, which displays images based on information in the active region of the frame and performs one or more operations concurrently with the vertical blanking region. In some embodiments, the source processor defers transmitting a request to display a frame to the display system until the display system indicates that it is completed performing the one or more operations, thereby increasing the duration of the vertical blanking region of the frame.

At decision block 420, the source processor determines whether the display system still requires the longer vertical blanking region. Some embodiments of the display system provide an indication that the one or more operations are complete, which indicates that the display system no longer needs the longer vertical blanking region. If the display system no longer requires the longer vertical blanking region because the operation is complete, the method 400 flows to block 405 and the source processor reduces the duration of the vertical blanking region. If the display system still requires the longer vertical blanking region because the operation is not complete, the method 400 flows to the block 415.

A computer readable storage medium may include any non-transitory storage medium, or combination of non-transitory storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

In some embodiments, certain aspects of the techniques described above may implemented by one or more processors of a processing system executing software. The software includes one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An apparatus, comprising:

at least one processor configured to:

send frame data to a display system that supports variable refresh rates, wherein a refresh rate of the display system corresponds to a first duration of a vertical blanking period corresponding to a vertical blanking region of a first frame; and perform operations during vertical blanking periods, wherein the at least one processor is configured, in response to detecting that an operation duration of an operation to be performed during a vertical blanking period of at least one subsequent frame exceeds the first duration, to increase a vertical blanking period corresponding to a vertical blanking region of a second frame to a second duration.

2. The apparatus of claim 1, wherein the first duration of the vertical blanking period is a minimum duration that corresponds to a maximum refresh rate supported by the display system.

3. The apparatus of claim 1, wherein the at least one processor is configured to increase the first duration to the second duration while maintaining durations of active periods corresponding to active regions of frames and maintaining durations of pixel clock rates of the frames.

4. The apparatus of claim 1, wherein the operation to be performed during the vertical blanking period of the at least one subsequent frame comprises at least one of changing a power state of the display system or adjusting a clock frequency of the display system.

5. The apparatus of claim 1, wherein the at least one processor is configured to confirm that the display system supports variable refresh rates in response to the at least one processor being connected to the display system.

6. The apparatus of claim 5, wherein the at least one processor is configured to selectively enable or disable modifications to durations of the vertical blanking period based on whether the display system supports variable refresh rates.

7. A method comprising:

sending frame data comprising a vertical blanking region corresponding to a vertical blanking period having a first duration to a display system that supports variable refresh rates; and in response to detecting that an operation duration of an operation to be performed during the vertical blanking period of at least one subsequent frame exceeds the first duration, increasing the first duration to a second duration.

8. The method of claim 7, wherein the first duration of the vertical blanking period is a minimum duration that corresponds to a maximum refresh rate supported by the display system.

9. The method of claim 7, wherein increasing the first duration comprises increasing the first duration to the second duration while maintaining durations of active periods corresponding to active regions of frames and maintaining durations of pixel clock rates of the frames.

10. The method of claim 7, wherein detecting that the operation duration of the operation exceeds the first duration comprises receiving information indicating that the operation includes changing a power state of the display system.

11. The method of claim 7, wherein detecting that the operation duration of the operation exceeds the first duration comprises receiving information indicating that the operation includes adjusting a clock frequency of the display system.

12. The method of claim 7, further comprising:

deferring transmission of a request to a display a frame to the display system until receiving an indication that the operation is complete.

13. The method of claim 12, further comprising:

decreasing the second duration in response to receiving the indication that the operation is complete.

14. The method of claim 7, further comprising:

in response to being connected to the display system, determining whether the display system supports variable refresh rates.

15. A display system that supports variable refresh rates, the display system comprising:

a timing reference; and a display controller coupled to the timing reference and configured to present, based on the timing reference, frames that comprise a vertical blanking region corresponding to a vertical blanking period having a first duration, wherein the first duration is to be increased to a second duration in response to information indicating that an operation duration of an operation to be performed by the display system during the vertical blanking period of at least one subsequent frame exceeds the first duration.

16. The display system of claim 15, wherein the first duration of the vertical blanking period is a minimum duration that corresponds to a maximum refresh rate supported by the display system.

17. The display system of claim 15, wherein the first duration is increased to the second duration while maintaining durations of active periods corresponding to active regions of the frames and maintaining durations of pixel clock rates of the frames.

18. The display system of claim 15, wherein the operation comprises at least one of changing a power state of the display system or adjusting a clock frequency of the display system.

19. The display system of claim 15, wherein the display system is configured to transmit an indication that the operation is complete.

20. The display system of claim 19, wherein the second duration is decreased in response to transmitting the indication that the operation is complete.

* * * * *